United States Patent [19]

Ruff

[11] Patent Number: 4,633,201

[45] Date of Patent: Dec. 30, 1986

[54] ROTARY WAVEGUIDE SWITCH HAVING MAGNETIC MEANS FOR AN ACCURATE POSITIONING THEREOF

[75] Inventor: Gerd Ruff, Heidelberg, Fed. Rep. of Germany

[73] Assignee: Teldix GmbH, Heidelberg, Fed. Rep. of Germany

[21] Appl. No.: 684,901

[22] Filed: Dec. 21, 1984

[30] Foreign Application Priority Data

Dec. 22, 1983 [DE] Fed. Rep. of Germany ..... 3346449
May 5, 1984 [DE] Fed. Rep. of Germany ..... 3416704

[51] Int. Cl.[4] ..... H01P 1/10

[52] U.S. Cl. ..... 333/106; 333/108; 333/259; 335/4; 310/36; 310/30

[58] Field of Search ..... 333/106, 108, 105, 259, 333/258, 257, 256, 261, 262; 335/4, 5, 69; 310/36, 38, 28, 20, 30

[56] References Cited

U.S. PATENT DOCUMENTS

| | | | |
|---|---|---|---|
| 2,901,708 | 8/1959 | Meadows | 333/106 |
| 2,905,908 | 9/1959 | Holzschuh et al. | 333/106 |
| 2,917,719 | 12/1959 | Brown | 333/108 |
| 2,942,208 | 6/1960 | Lapidus et al. | 333/106 |
| 3,119,974 | 1/1964 | Zavesky | 333/259 |
| 4,370,631 | 1/1983 | Gerber et al. | 333/106 |
| 4,447,793 | 5/1984 | Gray | 333/106 |
| 4,520,331 | 5/1985 | Steidel | 333/106 X |

FOREIGN PATENT DOCUMENTS

| | | | |
|---|---|---|---|
| S 39444 | 5/1956 | Fed. Rep. of Germany . | |
| 1905826 | 9/1969 | Fed. Rep. of Germany . | |
| 2924969 | 1/1980 | Fed. Rep. of Germany . | |
| 2850444 | 3/1980 | Fed. Rep. of Germany . | |
| 0675493 | 7/1979 | U.S.S.R. | 333/108 |
| 0723699 | 3/1980 | U.S.S.R. | 333/106 |

*Primary Examiner*—Eugene R. LaRoche
*Assistant Examiner*—Benny Lee
*Attorney, Agent, or Firm*—Spencer & Frank

[57] ABSTRACT

A waveguide switch includes housing walls defining a switch housing; at least two waveguide terminals provided in the housing walls; a rotor supported for rotation in the housing; at least one waveguide element contained in the rotor for coupling to one another at least two waveguide terminals in a predetermined angular operating position of the rotor; a motor for turning the rotor into the vicinity of a desired operating position and blocking assembly for arresting the rotor in the desired operating position. The blocking assembly and the rotor include a magnetic arrangement for turning the rotor from the vicinity of the desired operating position into the desired operating position by magnetic attraction.

11 Claims, 10 Drawing Figures

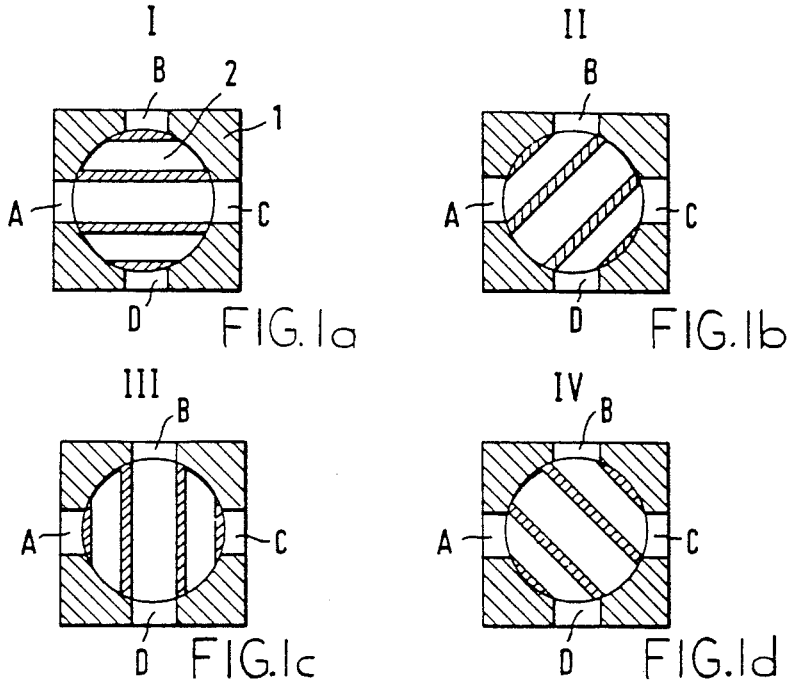
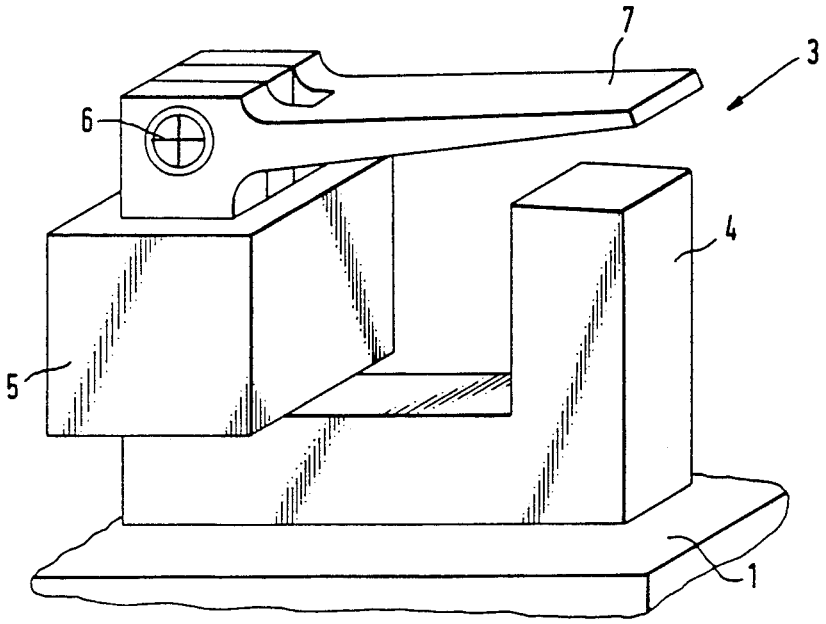
FIG. 2

ROTARY WAVEGUIDE SWITCH HAVING MAGNETIC MEANS FOR AN ACCURATE POSITIONING THEREOF

BACKGROUND OF THE INVENTION

This invention relates to a waveguide switch including a housing, at least two waveguide terminals provided in the housing wall and a rotor accommodated in the housing and including at least one waveguide element to couple at least two of the waveguide terminals with one another in a predetermined position of the rotor. The waveguide switch further has a motor for driving the rotor and a blocking assembly for immobilizing the rotor in a predetermined angular position.

A waveguide switch of the above-outlined type is known and is disclosed, for example, in German Offenlegungsschrift (published non-examined application) No. 2,924,969 which describes a waveguide switch with four waveguide terminals and a rotor which has three waveguide connecting paths. The switch permits a cross connection of two simultaneously applied high frequency signals when the rotor assumes a first or mid position. In addition, the rotor may assume two other positions which differ by 45° from the mid position and in which, in each instance, two adjoining waveguide terminals are connected with one another. A stepping motor is provided for turning the rotor into its selected position. Blocking members such as screws are used to immobilize the rotor.

It has been found that the rotor must be positioned with high precision with respect to the waveguide terminal flanges in order to avoid losses. A radial or axial misalignment of the waveguide connecting path with respect to the waveguide terminals causes a damping or a reduction of the transmission factor. It has also been found that with conventional screw abutments the required accuracy cannot be achieved.

SUMMARY OF THE INVENTION

It is an object of the invention to provide an improved waveguide switch in which the rotor is turned rapidly and with high accuracy into selected operating positions and thus electric losses are avoided.

This object and others to become apparent as the specification progresses, are accomplished by the invention, according to which, briefly stated, the motor turns the rotor into the vicinity of the desired rotor position (selected operating position) and the rotor blocking assembly, by means of magnetic attraction forces, turns the rotor into the precise operating position.

The invention provides that the rotor is not moved directly into its operating position and immobilized thereafter, but rather, after an initial (coarse) alignment of the rotor by the motor the rotor is, by magnetic attraction forces, moved into its desired operating position and is immobilized there by the generated magnetic forces.

According to a further feature of the invention, the blocking assembly comprises a pivotal lever which is maintained in its withdrawn (inoperative) position by means of an electromagnet during the turning motion of the rotor caused by the motor. For this purpose, the motor is connected in series with the electromagnet and thus, as long as current flows through the motor, the electromagnet is energized, and the pivotal blocking lever is maintained by the electromagnet in the withdrawn position. As the rotor reaches its predetermined position of coarse alignment, the motor current is switched off, and thus the blocking member, urged by a spring force, pivots into the operative (blocking) position, whereupon magnetic attracting forces become effective for turning the rotor in the desired precise operating position. For this purpose, for example, the rotor carries permanent magnets and the blocking lever has ferromagnetic properites. Thus, by interaction, a magnetic torque is exerted on the rotor, turning it into the desired operating position. During this occurrence, the rotor turns only a few degrees to ensure that the abutting forces remain small. When the operating position of the rotor is to be changed, the pivotal blocking lever is moved into its inoperative position by the electromagnet energized anew by the motor current. This electromagnetic force should be sufficiently large to generate a sufficient shearing force between the rotor and the lever to move the lever into its withdrawn position, overcoming the friction with the rotor.

According to a further feature of the invention, the support of the pivotal blocking lever and the generation of the spring force is performed by a cross spring joint. Apart from the reduction of the number of components, such a mechanism ensures a play-free support for the pivotal blocking lever.

For increasing the reliability of accurately setting the rotor, according to a further feature of the invention, a sensor is provided which responds to the position of the rotor. Such a sensor may comprise reed contact switches which are actuated by a permanent magnet mounted on the rotor. It is to be understood that Hall sensors, optical sensors or microswitches may be used instead.

Instead of a mechanical pivotal blocking lever, the immobilization of the rotor may be effected by utilizing solely magnetic attraction forces. For this purpose, on the rotor and stator radially facing permanent magnets separated by an air gap or a permanent magnet and coupling members for closing the magnetic circuit are provided. If the rotor is brought into a position in which it is exposed to a mutual attraction between the magnet parts of the rotor and the housing, the magnetic forces maintain the rotor in the desired position. By arranging a plurality of magnets in a circumferential distribution, several operating positions for the rotor may be determined.

In case the rotor is to be brought only in a single end position, that is, in a position in which a further rotation of the rotor is no longer necessary, a mechanical abutment suffices, in which case the immobilizing effect is increased by a magnetic force.

According to a further feature of the invention, the waveguide switch has a modular structure for adapting desired components to thus ensure a high accuracy in any mode of application and for significantly simplifying the replacement of components. According to a further feature of the invention, the bearing unit is composed of individual components for serving as the rotor bearing and as a support for the drive motor or its rotary component. It is a particular advantage of the invention that it provides for the mounting of additional switching components on adaptor surfaces on the switching component for a simultaneous actuation by the drive motor.

BRIEF DESCRIPTION OF THE DRAWING

FIGS. 1*a*, 1*b*, 1*c* and 1*d* are schematic cross-sectional views of a conventional four-position waveguide switch adapted for use with the invention and illustrated, respectively, in its four different operating positions.

FIG. 2 is a perspective view of some of the components of the preferred embodiment.

DESCRIPTION OF THE PREFERRED EMBODIMENTS

FIGS. 1*a*–1*d* illustrate the structural and operational principle of a known waveguide switch for interconnecting or separating from one another different waveguides paths and may be required, for example, to operatively couple standby microwave equipment to a system in order to replace a defective device if such measures are necessary for reasons of operational safety. Such a safety arrangement is often mandatory equipment for space vehicles or satellites. The waveguide switch comprises a housing 1 in which four symmetrically arranged waveguide terminals A, B, C and D are provided. A rotor 2 disposed in the housing 1 is rotatable therein and has three parallel waveguide paths. In order to combine (that is, to operatively couple) the waveguide terminals with one another, four possible switching positions I–IV are provided. Thus, in position I (FIG. 1*a*) the terminals A and C, in position II (FIG. 1*b*) the terminals A and B as well as C and D, in position III (FIG. 1*c*) the terminals B and D and in position IV (FIG. 1*d*) the terminals B and C as well as A and D are connected with one another. By virtue of the cube-shaped configuration of the switching housing 1 several switches may be combined with one another in a desired manner so that a great number of switch combinations may be realized.

It has been found that for ensuring small transmission losses, a high degree of positional accuracy of the rotor is necessary. Conventional stepping motors, because of their stepping angle hysteresis, do not have the required accuracy.

Figure 3:
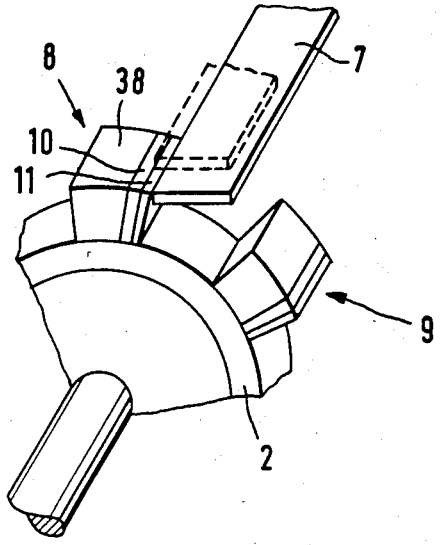
FIG. 3 is a perspective view of additional components of the preferred embodiment, depicted in an operative position.
Figure 4:
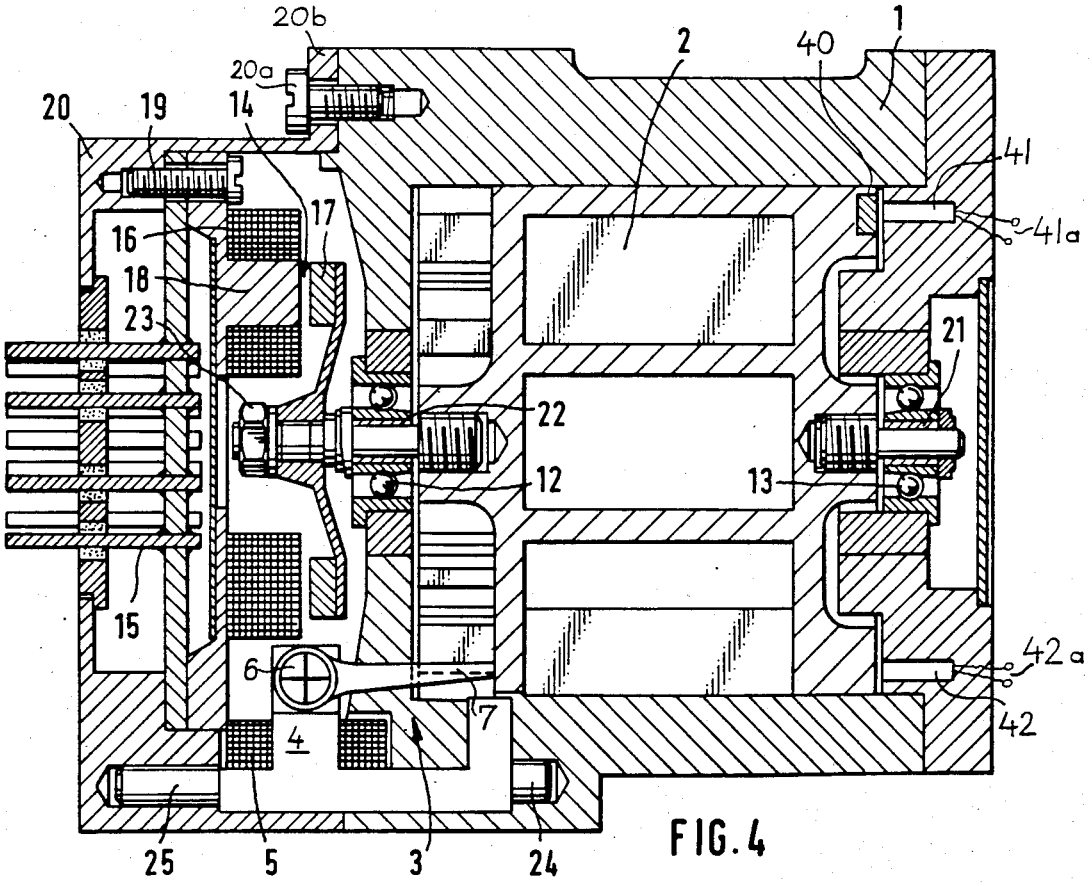
FIG. 4 is an axial sectional view of a preferred embodiment of a waveguide switch according to the invention.

A preferred embodiment of a rotor blocking and immobilizing arrangement according to the invention is illustrated in FIGS. 2, 3 and 4.

The basic construction and operational principle of a blocking assembly is illustrated in FIG. 2. The blocking assembly generally designated at 3 operates as a solenoid switch (relay) and has a U-shaped iron core 4 affixed to the housing 1 and surrounded by a solenoid 5. At the end of one leg of the iron core 4 a blocking lever 7 is pivotally supported by means of a cross spring joint 6 which is a frictionless and play-free bearing, also generating a return spring force urging the blocking lever 7 against an abutment into the illustrated position. As will be explained in connection with FIG. 3, an immobilization of the rotor 2 by the blocking lever 7 is effected when the solenoid 5 is in a de-energized state, as illustrated in FIG. 2. For further rotating the rotor 2, the solenoid 5 is energized, whereby the lever 7 is attracted to the core 4, thus releasing the rotor 2.

FIG. 3 illustrates the immobilization of the rotor 2 in greater detail. The rotor 2 has two positioning abutments 8 and 9, each formed of a base body 38, a magnet plate 10 made of a permanent magnetic material and an abutment plate 11. For setting the rotor 2 into a determined operating position, first the rotor is, during the energized state of the solenoid 5, turned by a stepping motor (not shown in FIG. 3) into the vicinity of its final position. The withdrawn position of the pivotal blocking lever 7 during this step is shown in phantom lines. Upon switching off the stepping motor, the solenoid 5 is also de-energized, whereupon the lever 7 is moved radially inwardly relative to the rotor 2 by the cross spring joint 6 into the operative position. By virtue of the magnetic attracting force of the magnet plate 10, the rotor 2 turns in the direction of the lever 7 until the abutment plate 11 arrives into contact with the lever 7. In this manner a high-precision positioning of the rotor 2 into its desired operating position is ensured. A further rotation of the rotor 2 into a new operating position is effected by energizing the solenoid 5 whereupon the pivotal blocking lever 7 is attracted in a radial direction into its inoperative, withdrawn position thus freeing the rotor 2. It is seen that for this purpose no counter force corresponding to the attracting force of the magnet plate 10 is required: solely an appropriate shearing force has to be applied for moving the lever 7. The stepping motor thereafter turns the rotor 2 into the vicinity of its new desired operating position.

Turning now to FIG. 4, there is illustrated a full structural embodiment of a waveguide switch according to the invention. In the housing 1 there are situated the rotor 2, rotor bearings 12, 13, a stepping motor 14, the blocking assembly 3 as well as terminal pins 15 for supplying current to the motor 14 and the solenoid 5.

The stepping motor 14 has stator coils 16 which are distributed in such a manner about the stator circumference that upon energization of a selected stator coil 16 the rotor 2 is turned by magnetic forces into the respective approximate operating position. To increase the degree of efficiency, a coil pair may be provided, and further, the magnet 17 mounted on the rotor 2 may be in a two-pole state by virtue of axial magnetization. In the first-mentioned instance, the magnet 17 is an axially oriented permanent magnet. The stator coils 16 are mounted on a magnetic coupling carrier 18, while the latter is mounted in a motor housing 20 by securing screws 19. The motor housing 20 is arranged at an end of the housing 1 and is mounted thereon by means of securing screws 20*a* (only one shown) passing through a mounting flange 20*b* of the motor housing 20.

The rotor bearing 12, 13 comprises grooved ball bearings which are inserted on opposite stub shafts of the rotor 2 with the interposition of respective bearing sleeves 21, 22 and are biased by a setting nut 23. A radial air gap of a few microns between the rotor 2 and the housing 1 ensures free rotation of the rotor, while the high frequency losses are maintained at a minimum. The blocking assembly 3 is connected with the switch housing 1 and the motor housing 20 by means of respective positioning pins 24 and 25.

Figure 5:
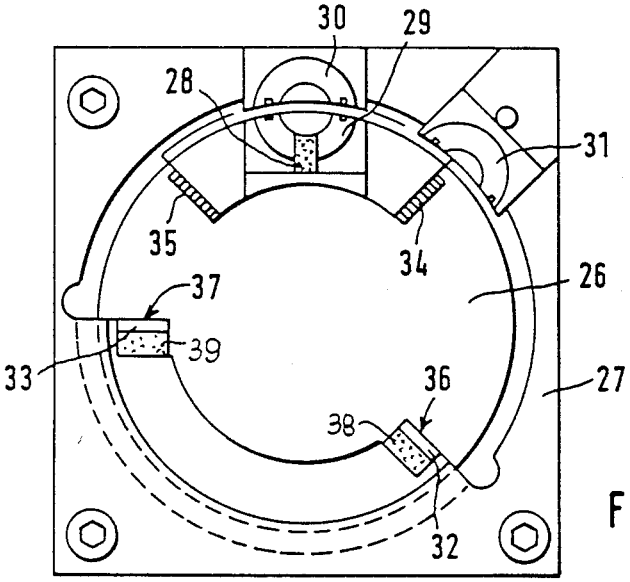
FIG. 5 is an end elevational view of components of another preferred embodiment.

Another preferred embodiment of the invention is illustrated in FIG. 5. In this construction, the rotor 26, conventionally supported by a bearing in the housing 27 of the waveguide switch is limited to a 135° rotation. The rotor 26 is designed for four operating positions, namely, two end positions which represent the two limits of the 135° freedom of rotation and two intermediate operating positions. The four positions are offset 45° to one another.

For determining the two limit positions, the housing 27 has two stationary abutment assemblies 36 and 37 which cooperate with two respective ferromagnetic abutment plates 34 and 35 carried by the rotor 26 and spaced 90° from one another. The abutment assembly 36 is composed of a permanent magnet 38 and an abutment plate 32 whereas the abutment asesmbly 37 is formed of a permanent magnet 39 and an abutment plate 33. For setting, for example, the rotor 26 into its end position determined by the abutment assembly 36, an electric motor (not shown) turns the rotor 26 until the ferromagnetic plate 34 is in the vicinity of the abutment assembly 36. Then the motor is de-energized and the rotor 26 is turned into its precise position by the magnetic attracting force exerted by the magnet 38 on the ferromagnetic plate 34. The magnetic force thereafter holds the rotor 26 in position by maintaining, by magnetic force, the ferromagnetic plate 34 in a face-to-face contact with the abutment plate 32.

For blocking and maintaining the rotor 26 in either one of its two intermediate positions, a permanent magnet 28 is provided which is surrounded by a half yoke member 29, both mounted on the rotor 26. In the desired operating position the housing 27 carries two stationary half yokes 30 and 31 offset at 45° from one another.

If the rotor 26 is to be brought into its operating position illustrated in FIG. 5, the electric motor moves the rotor 26 until the magnetic assembly 28, 29 arrives in the vicinity of the stationary coupling yoke (half yoke) 30 whereupon, after de-energization of the motor, the rotor 26 is moved, by magnetic forces interacting between the assembly 28, 29 and the coupling yoke 30 into the precise shown position.

By virtue of the particular, pole shoe-like configuration of the pole of the half yoke 29 and the cooperating half yoke 30, the rotor body 26 is, solely by the magnetic forces acting thereon, held in the shown position with high accuracy.

In the same described manner, positioning of the rotor body 26 may be effected in its other end position at the magnetic assembly 37 or in its intermediate position at the coupling yoke 31. It is to be understood that the driving torque of the motor has to be large enough to overcome the torque generated by the magnets 28, 38 and 39. It will be further understood that the number of operating positions as well as the angle of rotation may vary from structure to structure.

It is expedient to provide a sensor arragement for indicating the position of the rotor. For this purpose, conventional position sensors such as optical gates, reed switches or the like may be used. Such arrangements help to eliminate switching errors which may lead to a breakdown of the high frequency circuitry.

Figure 6:
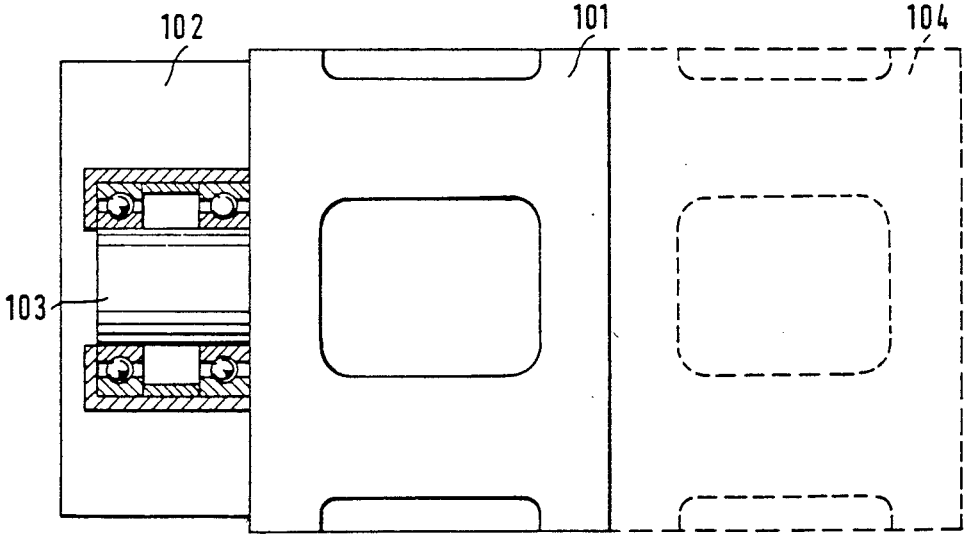
FIG. 6 is a schematic side elevational view of a further embodiment of the invention.

FIG. 6 illustrates still another preferred embodiment of the invention, showing a waveguide switch of modular construction. The waveguide switch comprises a switching unit 101 of the type described in connection with FIGS. 1*a* through 1*d*, a motor 102 and a bearing unit 103 which is arranged between the motor 102 and the switching unit 101. The motor 102 is so designed that it may surround the bearing unit 103, or, in the alternative, the components 102 and 103 are axially juxtaposed. In case a further switching unit 104 (shown in phantom lines) is to be associated with the same motor 102, such additional switching unit may be secured to the end face of the first switching unit 101. The bearing unit 103 may comprise a ball bearing or any other type of suitable low friction support arrangements. It is of decisive importance that the support of the rotary waveguide switch has a low friction and a small bearing torque to ensure the required accuracy.

Figure 7:
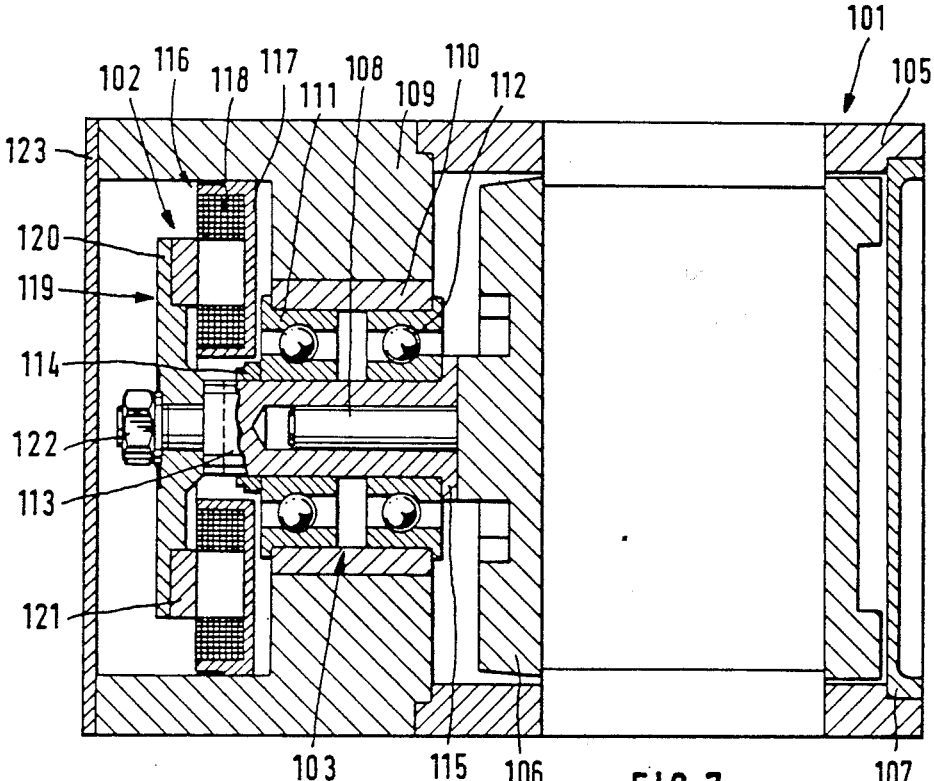
FIG. 7 is an axial sectional view of the embodiment illustrated in FIG. 6.

Turning now to FIG. 7, there is shown in detail the construction of the preferred embodiment illustrated in FIG. 6.

The switching unit 101 comprises a housing 105 which is provided with the appropriate waveguide terminals, a rotor 106 and an end closure 107. The rotor 106 has an axial pin-like extension 108 which adapts the rotor 106 to the bearing unit 103. The latter comprises a bearing housing 109, a bearing ring 110, axially clamped shoulder ball bearings 111, 112, a shaft 113 and a tensioning ring 114. By tensioning the ball bearings 111 and 112 by means of the tensioning ring 114 against an abutment face 115 of the shaft 113 there is obtained a support which is play-free and—by using a single material for all bearing portions—which ensures a constant bias (clamping force) independently from the surrounding temperatures.

The motor 102 comprises a stator 116 which has a winding support 117 carrying stator windings 118. The stator 116 is secured within a cylindrical cavity of the bearing housing 109. The rotor part 119 of the motor 102 is formed of a magnet carrier 120 and permanent magnet segments 121. The rotor part 119 is directly mounted on the shaft 113 of the bearing unit 103 by means of a screw connection 122. The arrangement of the windings 118 and the segments 121 as well as the energization of the windings 118 and the blocking and immobilization of the rotor 106 are effected as described earlier in connection with the embodiment illustrated in FIGS. 2, 3 and 4. By means of a closure plate 123, the motor 102 and the bearing unit 103 are covered endwise and are thus protected from external effects.

By virtue of the modular construction of the waveguide switch according to the embodiment shown in FIGS. 6 and 7, a ready exchangeability of the individual elements is feasible without any loss in accuracy. Further, by selecting the individual elements, an adaptation of the switch to the desired mode of application may be easily effected.

In FIG. 4 sensor means for indicating the angular positions of the rotor 2 are provided, consisting of one permanent magnet 40 on rotor 2 and four reed-switches on housing 1. In FIG. 4 only two of these reed-switches 41, 42 are shown. If the permanent magnet 40 reaches the position of one of these reed-switches (for example the reed-switch 41 as shown) this reed switch closes and generates a position signal on its wires 41*a* or 42*a* (for example the 41*a* as shown). The occurence of this signal shows that the rotor has reached the desired position.

It will be understood that the above description of the present invention is susceptible to various modifications, changes and adaptations, and the same are intended to be comprehended within the meaning and range of equivalents of the appended claims.

What is claimed is:

1. In a wavelength switch including housing walls defining a switch housing; said housing walls comprising a hollow cylindrical wall portion; at least two waveguide terminals provided in said housing walls and opening into said hollow cylindrical wall portion at a predetermined distance from one another as viewed circumferentially around said hollow cylindrical wall portion; a rotor supported for rotation in a space surrounded by said hollow cylindrical wall portion; at least one waveguide element contained in said rotor for coupling to one another at least two waveguide terminals in a predetermined angular operating position of said rotor wherein said waveguide element is in alignment with said at least two waveguide terminals; the improvement comprising (a) motor means coupled to said rotor for turning said rotor to a coarse position adjacent a desired precise operating position in which said alignment is of high accuracy;

(b) a blocking member movably mounted in said housing and having a blocking position in which it is situated in a rotary path of said rotor at a location so as to abut said rotor in said desired precise operating position thereof and a withdrawn position in which it is situated withdrawn from said rotary path so as to allow rotation of said rotor freely past said desired precise operating position;

(c) means for moving said blocking member into, and maintaining it in, said blocking position upon said rotor reaching said coarse position;

(d) means for moving said blocking member into and maintaining it in, said withdrawn position upon movement of said rotor towards said coarse position; and (e) magnetic means carried by said rotor and said blocking member for turning said rotor by magnetic attraction between said rotor and said blocking member from said coarse position into an abutting relationship with said blocking member, whereby said rotor assumes said desired precise operating position; said magnetic attraction being effective solely in said blocking position of said blocking member.

2. A waveguide switch as defined in claim 1, further including sensor means mounted in said housing adjacent said rotor for indicating angular positions of said rotor.

3. A waveguide switch as defined in claim 1, further comprising a solenoid energized and de-energized simultaneously with an energization and de-energization of said motor means, said blocking member responding to an energized and a de-energized state of said solenoid; said blocking member assuming said withdrawn position in response to an energized state of said solenoid; said means for moving said blocking member into said blocking position comprises force exerting means for moving said blocking member into said blocking position in the de-energized state of said solenoid.

4. The waveguide switch as defined in claim 3, further comprising a joint means for pivotally supporting said blocking member; said joint means including a cross spring joint; said cross spring joint including said force exerting means.

5. A waveguide switch as defined in claim 3, wherein said magnetic means comprises a ferromagnetic material included in said blocking member and a permanent magnet affixed to said rotor.

6. A waveguide switch as defined in claim 5, further comprising an abutment mounted on said rotor; said permanent magnet being included in said abutment; said abutment being in an abutting contact with said blocking member in the blocking position thereof and in said precise desired operating position of said rotor.

7. A waveguide switch as defined in claim 1, wherein said rotor, said switch housing and said waveguide terminals form a switch unit and further wherein said motor means has a motor housing comprising a securing flange, further comprising fastening means for attaching said motor housing at said securing flange to said switch housing.

8. A waveguide switch as defined in claim 7, further comprising a bearing unit held in said switch housing and supporting said rotor.

9. A waveguide switch as defined in claim 7, wherein on said switch housing at a location remote from said motor means, an additional switch unit is mounted.

10. A waveguide switch as defined in claim 8, wherein said motor means has a rotary component support by said bearing unit.

11. In a waveguide switch including housing walls defining a switch housing; said housing walls comprising a hollow cylindrical wall portion; at least two waveguide terminals provided in said housing walls and opening into said hollow cylindrical wall portion at a predetermined distance from one another as viewed circumferentially around said hollow cylindrical wall portion; a rotor supported for rotation in a space surrounded by said hollow cylindrical wall portion; at least one waveguide element contained in said rotor for coupling to one another at least two said waveguide terminals in a predetermined angular operating position of said rotor wherein said waveguide element is in alignment with said at least two waveguide terminals; the improvement comprising motor means coupled to said rotor for turning said rotor to a coarse position adjacent a desired precise operating position in which said alignment is of high accuracy; blocking means mounted in said housing for arresting said rotor in said desired precise operating position; said blocking means and said rotor including magnetic means for turning said rotor from said coarse position into said desired precise operating position by magnetic attraction; said magnetic means comprising a permanent magnet member and a first magnetic yoke half carrying said permanent magnet member and being mounted on said rotor for movement therewith as a unit; a second magnetic yoke half supported stationarily in said desired precise operating position; said first and second magnetic yoke halves and said permanent magnet forming a magnetic circuit when said rotor is in said coarse position, whereby a magnetic force generatd by said magnetic circuit moves said rotor into and maintains it in said desired precise operating position.

* * * * *